United States Patent [19]

Zuuring

[11] 4,314,708

[45] Feb. 9, 1982

[54] ICE SKATE BLADE

[75] Inventor: Peter F. Zuuring, Baie d'Urfé, Canada

[73] Assignee: PFZ Enterprises Inc., Quebec, Canada

[21] Appl. No.: 51,042

[22] Filed: Jun. 22, 1979

[30] Foreign Application Priority Data

Jun. 7, 1979 [CA] Canada ..... 329428

[51] Int. Cl.[3] ..... A63C 1/32

[52] U.S. Cl. ..... 280/11.18; 280/28

[58] Field of Search ..... 280/11.18, 11.12, 11.17, 280/11.16, 11.15, 11.14, 600, 7, 13, 11, 1 R, 28, 12 H, 12 K, 12 KL, 609, 601, 12 R, 12 F; 244/108; 9/310 A

[56] References Cited

U.S. PATENT DOCUMENTS

| | | | |
|---|---|---|---|
| 601,013 | 3/1898 | Evans | 280/11.12 |
| 1,218,451 | 3/1917 | Oelschlagel | 280/11.12 |
| 1,826,958 | 10/1931 | Sayer | 280/11.18 |
| 2,108,541 | 2/1938 | Lull | 280/12 R |
| 3,074,733 | 1/1963 | Norgiel | 280/11.18 |
| 3,558,149 | 1/1971 | Weidenbacker | 280/11.12 |

FOREIGN PATENT DOCUMENTS

| | | | |
|---|---|---|---|
| 2042462 | 3/1972 | Fed. Rep. of Germany | 280/11.18 |
| 481800 | 3/1938 | United Kingdom | 280/11.12 |

*Primary Examiner*—Joseph F. Peters, Jr.
*Assistant Examiner*—Milton L. Smith
*Attorney, Agent, or Firm*—Bachman and LaPointe

[57] ABSTRACT

An ice skate blade having an elongated flat blade body defining opposed side walls and a support bottom edge having a slot in at least a forward half portion thereof intermediate the opposed side walls. The rear portion is a solid support portion.

18 Claims, 6 Drawing Figures

ICE SKATE BLADE

BACKGROUND OF INVENTION (a) Field of the Invention

The present invention relates to an improved ice skate blade construction.

(b) Description of Prior Art

The conventional ice skate blade, as it is known today, consists of an elongated flat blade body having a solid narrow flat elongated support bottom edge. The bottom edge of the blades is slightly curved longitudinally and has a measurable manoeuverability and coefficient of friction.

SUMMARY OF INVENTION

It is a feature of the present invention to provide an ice skate blade which is improved over the above-mentioned conventional blade and has a reduced coefficient of friction.

A further feature of the present invention is to provide an ice skate blade which will permit the user to make sharper turns on an ice surface while having better support thereon due to a reduction in ice penetration resulting in a decrease of ice surface breakage.

Another feature of the present invention is to provide an ice skate blade having a means to improve the lubrication between the blade and an ice surface during use.

A still further feature of the present invention is to provide an ice skate blade which will permit a user to start and stop faster on an ice surface.

A still further feature of the present invention is to provide an ice skate blade which will permit the user to have better acceleration in sweeping curves and to improve forward and backward skating.

A still further feature of the present invention is to provide an ice skate blade having a slot in at least the forward half section of the blade and a wide solid support surface in a rear portion thereof.

According to the above features, from a broad aspect, the present invention provides an ice skate blade comprising an elongated flat blade body having opposed side walls and a support bottom edge. The bottom edge has a slot in at least a forward half portion thereof intermediate the opposed side walls.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figure 1:
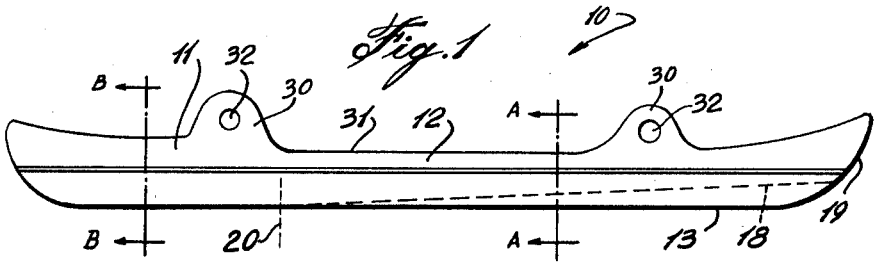
FIG. 1 is a side view of the ice skate blade of the present invention.
Figure 2:
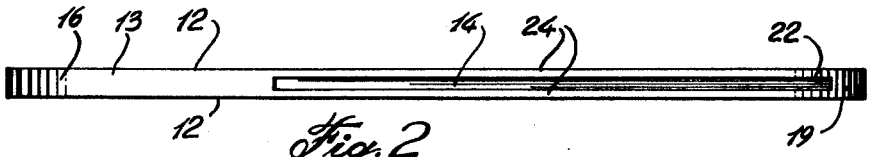
FIG. 2 is a bottom view of FIG. 1.

Referring now to the drawings, and more particularly to FIGS. 1 to 4, there is shown generally at 10, the improved ice skate blade of the present invention. The blade consists of an elongated flat blade body 11 having opposed side walls 12 and a support bottom edge 13. The bottom edge 13 has a medial slot 14 in at least a forward half portion thereof, herein in two-thirds the length of the blade in a front portion thereof intermediate the opposed side walls 12.

Figure 3:
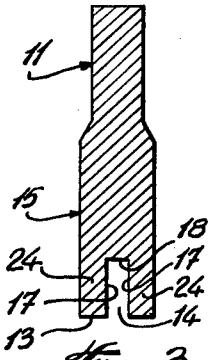
FIG. 3 is a cross-section view along cross-section lines A—A of FIG. 1.

As more clearly shown in FIG. 3, the flat blade body 11 has an enlarged lower portion 15 extending to the bottom edge 13. Thus, the bottom edge 13 is wider than the upper part of the body 11 and provides a wide support rear blade portion 16, behind the slot 14 (see FIG. 2). It can also be seen from FIG. 3, that the slot has a rectangular cross-section and defines substantially parallel inner side walls 17 and a transverse bottom wall 18.

Figure 5:
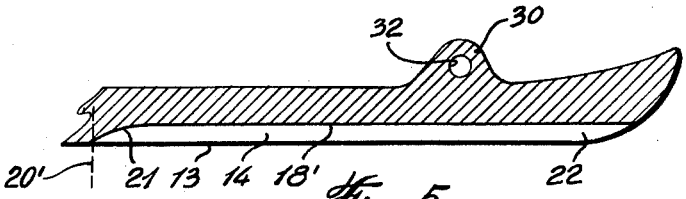
FIG. 5 is a fragmented longitudinal section view of the forward portion of the skate blade showing a modification thereof.

As shown in FIG. 1, the slot 14 is angularly disposed in the enlarged lower portion 15 and slopes rearwardly downwards from a curved front end 19 of the blade to a rear termination point 20 lying in the plane of the support bottom edge 13 and spaced two-thirds rearwardly of the front end 19 of the blade. FIG. 5 shows a further configuration of the slot wherein the transverse bottom wall 18' is herein disposed parallel to the bottom edge 13 and terminates in a downwardly sloping rear portion 21 terminating at the rear termination point 20'. In both embodiments of the configuration of the slot, the slot defines a slot front end opening 22.

Although not very apparent from FIG. 1, the bottom edge of the blade has a slight lengthwise convex curve, herein lying on the circumference of a radius of curvature in the range of about 12–15 feet. This results in a substantially flat support bottom edge 13.

Figure 4:
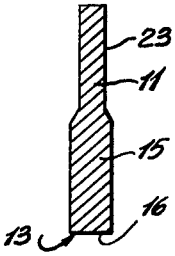
FIG. 4 is a cross-section view along cross-section lines B—B of FIG. 1.

As better seen from FIGS. 3 and 4, the enlarged lower portion 15 is approximately 25% thicker than the upper portion 23 of the blade body 11. This permits the shoulder portions 24 defined on each side of the slot 14 to be sufficiently thick to resist transverse impact when the skate blade is utilized in the sport of hockey where it is often subjected to transverse forces by hockey pucks or when hit by other foreign objects. Referring to FIG. 3, a typical dimension for the blade thickness in the upper portion 23, would be about 120 thousandths of an inch. The enlarged lower portion has a thickness of about 150 thousandths of an inch and the shoulder portions 24 each have a thickness lying in the range of about 40 to 50 thousandths of an inch with the slot having a width in the range of about 50 to 70 thousandths of an inch. The slot 14 is approximately $\frac{1}{4}$ inch in depth.

As shown in FIG. 1, the ice skate blade 10 is provided with suitable securement means, herein tongues 30, formed in the upper edge 31 of the blade and having through bores 32 therein to permit securement of the skate blade to an ice skate blade support (not shown). Other types of securement means may be provided to accommodate various types of skate blade supports and the blade could also be provided without securement means and be welded to a skate blade support.

The purpose for the provision of the slot 14 in at least the forward half section of the blade body 11 is to provide various advantages. One advantage is the reduction in the coefficient of friction between the lower edge 13 of the blade and an ice surface (not shown). In use, ice and snow from an ice surface will collect and compact in the channel 14 which acts as a reservoir whereby to stimulate a lubricating film which is created by the melting of ice under the bottom edge 13 during use. As the blade moves along the ice surface, snow compacts into the channel and melts with friction and replenishes itself automatically as the blade moves along the ice surface. Also, on each side of the slot 14 there is provided two thin shoulder blade portions 24, each portion 24 being thinner than conventional ice skate blades as presently in use. Thus, when the blade is angulated sideways of its normal plane during skating movements, one of the shoulder portions 24 will provide better penetration on the ice surface as it is thinner and thus provides better gripping on this surface. This improves the starting and stopping action of the user. Also, the two thin blades in combination with the long radius of curvature of the bottom edge, resulting in a substantially flat bottom edge, provides for better acceleration and stability in sweeping curve motions or in backward skating.

The support rear blade portion 16 of the bottom edge 13 is wider than conventional skate blades known today and this provides for the execution of sharper turns and better support during turning motions as the pressure during such motions is applied on the heel of a skate boot (not shown) directly above the rear blade portion 16. Also, the larger width of this portion 16 provides better support and reduces ice breakage under this portion which would normally result in a loss of energy as there would be more resistance.

As previously described, the slot 14 is a shallow slot whereby to maintain structural resistance of the blade in the enlarged lower portion 15. Further, the slot 14 may slope rearwardly downwards, as shown in FIG. 1, or may have a rearwardly sloping rear portion 21, as shown in FIG. 5, whereby to provide the self-lubrication effect mentioned above. This facilitates the discharge of water when the blade is displaced in a forward direction, thus resulting in increased acceleration and speed.

Figure 6:
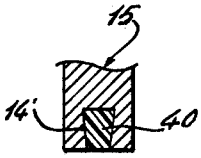
FIG. 6 is a fragmented section view illustrating a modification of the channel of the blade.

FIG. 6 illustrates a channel 14' constructed in such a manner as to be able to retain a soft hydrophobic material, such as "Teflon" (Registered Trademark) or high density polyethylene, therein. The purpose of this insert material is to further increase the surface tension of the lubricating film which forms between the blade and the ice surface. This further reduces the coefficient of friction already improved upon by the open channel filled with ice or snow. As shown, the channel 14' is of a dovetail cross-section.

It is within the ambit of the present invention to provide any obvious modifications of the ice skate blade construction as illustrated by the accompanying drawings, provided such modifications fall within the scope of the appended claims. For example, the lower edge 13 may have a slight transverse concave curvature to provide outer sharp elongated edges to still further reduce friction. Still further, the lower edge 13 of the shoulder portions 24 on each side of the slot may be shaped differently to provide sharper or pointed lower edges. The slot 14, may also have a different configuration, provided it serves for the same intended results.

I claim:

1. An ice skate blade for use on a surface of ice and characterized by a reduced coefficient of friction between said blade and said surface of ice comprising an elongated flat blade body having opposed side walls and a support bottom edge, said bottom edge having a single elongated slot in at least a forward half portion thereof intermediate said opposed side walls, a remaining rear portion of said bottom edge constituting a solid support rear portion and wherein said slot collects ice and snow from said surface of ice so as to form a lubricating film between said blade and said surface thereby providing said reduced coefficient of friction between said blade and said surface of ice.

2. An ice skate blade as claimed in claim 1 wherein said slot extends from a curved front end of said blade to define a slot front end opening.

3. An ice skate blade as claimed in claim 2 wherein said slot has a rectangular cross-section defining substantially parallel inner side walls and a transverse bottom wall.

4. An ice skate blade as claimed in claim 3 wherein said bottom wall slopes rearwardly downwards to a rear termination point in the plane of said support bottom edge.

5. An ice skate blade as claimed in claim 3 wherein said slot has a downwardly sloping rear portion terminating at a rear termination point in the plane of said support bottom edge.

6. An ice skate blade as claimed in claim 1 wherein said support bottom edge defines a slight lengthwise convex curve, said blade having a sharp curved front end, said slot extending from said curved front end to define a slot front end opening.

7. An ice skate blade as claimed in claim 6 wherein said lengthwise curve has a radius of curvature in the range of about 12 to 15 feet.

8. An ice skate blade as claimed in claim 1 wherein said elongated flat body has an enlarged lower portion extending to said bottom edge, said slot extending partway into said enlarged lower portion.

9. An ice skate blade as claimed in claim 8 wherein said enlarged lower portion is approximately 25 percent thicker than said blade body.

10. An ice skate blade as claimed in claim 8 wherein said slot is a medial slot, said blade defining shoulder portions on each side of said slot.

11. An ice skate blade as claimed in claim 10 wherein said blade body has a thickness of about 120 thousandths of an inch, said enlarged lower portion having a thickness of about 150 thousandths of an inch, each said shoulder portions having a thickness in the range of about 40–50 thousandths of an inch, and said slot having a width in the range of about 50–70 thousandths of an inch.

12. An ice skate blade as claimed in claim 11 wherein said slot is approximately $\frac{1}{4}$ inch deep.

13. An ice skate blade as claimed in claim 1 wherein said solid support rear portion extends along approximately one-third of the total length of said blade body, said slot extending along approximately two-thirds of said total length.

14. An ice skate blade as claimed in claim 13 wherein said support bottom edge has a lengthwise convex curve having a radius of curvature in the range of about 12 to 15 feet.

15. An ice skate blade as claimed in claim 14 wherein said blade body has a curved front and rear ends, said slot being of rectangular cross-section defining substantially parallel inner side walls and a transverse bottom wall spaced inwardly from said bottom edge, said slot extending from said curved front end of said blade to define a slot front end opening, said transverse bottom wall being a straight wall extending from said curved front end and sloping rearwardly downwards to a rear termination point in the plane of said support bottom edge two-thirds of said total length.

16. An ice skate blade as claimed in claim 1 wherein said blade body is provided with securement means in a top end edge portion thereof for securing said blade to an ice skate blade support.

17. An ice skate blade comprising an elongated flat blade body having opposed side walls and a support bottom edge, said bottom edge having a single elongated slot in at least a forward half portion thereof intermediate said opposed side walls, and an insert material retained in said slot, said insert material being of a different composition than said blade and having properties to affect water film properties, a remaining rear portion of said bottom edge constituting a solid support rear portion.

18. An ice skate blade as claimed in claim 17 wherein said insert material is a hydrophobic material.

* * * * *